US008328188B2

(12) United States Patent
Mandel et al.

(10) Patent No.: US 8,328,188 B2
(45) Date of Patent: Dec. 11, 2012

(54) METHOD AND SYSTEM FOR SKEW AND LATERAL OFFSET ADJUSTMENT

(75) Inventors: Barry Paul Mandel, Fairport, NY (US); Joannes N. M. deJong, Hopewell Jct, NY (US); Lloyd A. Williams, Mahopoc, NY (US)

(73) Assignee: Xerox Corporation, Norwalk, CT (US)

( * ) Notice: Subject to any disclaimer, the term of this patent is extended or adjusted under 35 U.S.C. 154(b) by 1925 days.

(21) Appl. No.: 11/141,545

(22) Filed: May 31, 2005

(65) Prior Publication Data

US 2006/0267271 A1 Nov. 30, 2006

(51) Int. Cl.
*B65H 7/02* (2006.01)

(52) U.S. Cl. ..... 271/228; 271/249; 271/252

(58) Field of Classification Search ..... 271/226–228, 271/236, 252–254, 249
See application file for complete search history.

(56) References Cited

U.S. PATENT DOCUMENTS

| | | | | |
|---|---|---|---|---|
| 4,685,664 | A | 8/1987 | Petersdorf | |
| 4,836,527 | A * | 6/1989 | Wong | 271/251 |
| 4,971,304 | A | 11/1990 | Lofthus | |
| 5,169,140 | A | 12/1992 | Wenthe, Jr. | |
| 5,219,159 | A | 6/1993 | Malachowski et al. | |
| 5,278,624 | A | 1/1994 | Kamprath et al. | |
| 5,794,176 | A | 8/1998 | Milillo | |
| 6,155,561 | A * | 12/2000 | Mandel | 271/254 |
| 6,168,153 | B1 | 1/2001 | Richards et al. | |
| 6,273,418 | B1 * | 8/2001 | Fujikura et al. | 271/228 |
| 6,533,268 | B2 | 3/2003 | Williams et al. | |
| 6,575,458 | B2 | 6/2003 | Williams et al. | |
| 6,578,844 | B2 | 6/2003 | Acquaviva et al. | |
| 6,603,953 | B2 | 8/2003 | Jewell | |
| 6,634,521 | B1 * | 10/2003 | Hwang | 221/228 |
| 6,736,394 | B2 * | 5/2004 | Herrmann et al. | 271/249 |
| 7,578,498 | B2 * | 8/2009 | Iguchi et al. | 270/58.07 |
| 2001/0024012 | A1 | 9/2001 | Kato | |
| 2003/0020230 | A1 * | 1/2003 | Williams et al. | 271/227 |
| 2003/0020231 | A1 | 1/2003 | Williams et al. | |
| 2003/0146567 | A1 | 8/2003 | Williams et al. | |
| 2004/0046313 | A1 | 3/2004 | Herrmann et al. | |
| 2004/0062582 | A1 | 4/2004 | Dobbertin et al. | |
| 2004/0150154 | A1 | 8/2004 | Howe | |
| 2004/0188929 | A1 * | 9/2004 | Tada et al. | 271/248 |
| 2004/0215411 | A1 | 10/2004 | Howe | |
| 2004/0251611 | A1 | 12/2004 | Rapkin | |
| 2004/0251613 | A1 | 12/2004 | Quesnel | |
| 2005/0012263 | A1 * | 1/2005 | Koyanagi et al. | 271/227 |
| 2005/0035536 | A1 * | 2/2005 | Suga et al. | 271/226 |
| 2005/0035539 | A1 | 2/2005 | Hashimoto | |
| 2005/0042008 | A1 | 2/2005 | Ochiai | |
| 2006/0261540 | A1 * | 11/2006 | Loiselle et al. | 271/228 |

FOREIGN PATENT DOCUMENTS

| | | |
|---|---|---|
| JP | 10067448 | 3/1998 |

* cited by examiner

*Primary Examiner* — Prasad Gokhale
(74) *Attorney, Agent, or Firm* — Maginot, Moore & Beck, LLP

(57) ABSTRACT

A system and method for registering a sheet includes a lateral motion motor coupled to a nip and idler roller assembly that provides lateral alignment of the sheet. A de-skew assembly pivots the lateral motion motor and the nip and idler roller assembly about a pivot axis that is proximate to the lateral motion motor to de-skew the sheet.

20 Claims, 6 Drawing Sheets

METHOD AND SYSTEM FOR SKEW AND LATERAL OFFSET ADJUSTMENT

TECHNICAL FIELD

The technical field relates to a sheet registration apparatus such as may be used in printing systems and more specifically to an active registration system.

BACKGROUND

Sheet registration systems deliver sheets of all kinds to a specified position and angle for a subsequent function within a printer, copier and other devices. The subsequent functions could include transferring an image to a sheet, stacking the sheet, slitting the sheet, etc. Conventional registration systems correct for skew and lateral offset. "Skew" is the angle of the leading edge of a sheet being transferred with respect to the direction of transfer. Lateral offset is the cross-process misalignment of the sheet being transferred with respect to the transfer path.

Skew contributors include the angle at which a sheet is supplied into the sheet drive apparatus, skew induced when the sheet is acquired by the feeder, and drive roller velocity differences between drive rollers on opposite ends of a common drive shaft. Lateral offset may be due to sheet supply location and sheet drive direction error. Sheet drive direction error is caused by the sheet drive shafts not being perpendicular to the intended sheet drive direction. This is a result of tolerances and excess clearance between drive shafts and frames, sheet transport mounting features and machine frames and machine module to module mounting.

In present day high speed copiers and printers, active registration systems are used to register the sheets accurately. In an active registration system, a sheet is passed over sensor arrays from which the sheet skew and lateral or cross process offset is calculated. In some registration systems, the sheet is then steered into the proper position by rotating drive rollers on opposite ends of a common drive axis at different velocities. This function must be performed within a specific time and distance, i.e. before the sheet passes out of the nip rollers. As the sheet is moved more rapidly to increase overall productivity, the time to register the sheet to correct for skew and lateral offset decreases. As the allotted time decreases, the speed and acceleration of the nip rollers increases. The increased speed and acceleration may result in a need for a larger motor to provide additional power. The increased speed and acceleration of the nip rollers may further result in early failure of the registration system.

Other known devices use a loop registration process. In accordance with a loop registration process, the leading edge of a sheet is brought into abutment against a non-moving nip and idler roller pair causing the sheet to bend. The leading edge of the sheet is thus aligned with the nip and idler roller pair by the elasticity of the sheet to correct skew. Thereafter, the nip and idler roller pair is rotated at a predetermined timing by a process or forward motion motor to move the sheet through the machine.

In such devices, a loop space for forming a loop is required which results in an increase in the size of the apparatus. In addition, when the skew of a sheet is too large for the space provided, a paper jam may occur due to the buckling of the sheet. Moreover, the skew correction ability is dependent upon the rigidity of the sheet. Specifically, a thick paper with high rigidity may actually thrust through the nip and idler roller pair as the sheet is forced against the nip and idler roller pair. While this problem may be avoided, such avoidance generally takes the form of additional equipment incorporated into the machine thereby increasing the cost and complexity of the machine.

Other automatic registration systems avoid the above problems by pivoting and translating the entire nip and idler roller assembly. In some of these devices, the skew of a sheet is first detected. Then, the nip and idler roller assembly is pivoted by a de-skew motor to match the detected skew condition prior to grasping the sheet with the nip and idler roller assembly. Once the paper is grasped by the nip and idler roller assembly, the nip and idler roller assembly are pivoted by the de-skew motor into a de-skewed position. The nip and idler roller assembly and the de-skewed sheet are then translated by a lateral motion motor to provide lateral alignment of the sheet.

In other systems, the sheet may be grasped by a nip and idler roller assembly while the nip and idler roller assembly is in a home position. Accordingly, the sheet is grasped in a skewed and laterally offset position with respect to the nip and idler roller assembly. The sheet and nip and idler roller assembly are then rotated and translated for de-skewing and lateral alignment of the sheet. This results in the nip and idler roller assembly being moved to a skewed position while the sheet is properly aligned. Then, after the sheet has left the nip and idler roller assembly, the nip and idler roller assembly is returned to the home position. In these systems, the skew sensors may be located before or after the nip and idler roller assembly.

The above discussed automatic registration systems are very effective in correcting skew and lateral offset. Nonetheless, there are some drawbacks associated with the above systems. For example, the motors used to effect the process motion and the translation (i.e. the process motor and the lateral motion motor) must be pivoted along with the nip and idler roller assembly. The pivoting of the extra mass necessitates a larger motor to provide the pivoting movement in the allotted time.

The problem of pivoting the additional mass is compounded by any distance between the mass and the pivot axis. Specifically, the pivot for the registration system is generally located underneath and toward the middle of the transfer path. Thus, the pivot axis is toward the middle of the transfer path. The motors, however, are located at the side of the transfer path. This separation creates a mechanical disadvantage both when starting the rotation and when stopping the rotation. The additional momentum that thus results necessitates more power from the motor used to provide the pivoting movement.

Of course, in view of the speed of many modern machines, even a slight increase in the mass being moved may necessitate a significant increase in the power, and therefore the size of the de-skew motor, to achieve the necessary movement within a very short time span.

SUMMARY

A sheet registration system and method that addresses limitations of previously known systems includes a lateral motion assembly that is located close to the axis of rotation of a nip and idler roller assembly. In one embodiment, a sheet transport system includes a lateral motion motor coupled to a nip and idler roller assembly to provide lateral alignment of a sheet being transported along a sheet transport path by the nip and idler roller assembly. A de-skew assembly coupled to the nip and idler roller assembly pivots the lateral motion motor and the nip and idler roller assembly about a pivot axis located proximate to the lateral motion motor to de-skew the sheet.

In one embodiment, a sheet is registered in a device by moving a nip and idler roller assembly along an axis substantially crosswise to the transport path with a lateral motion motor to provide lateral alignment of the sheet. The lateral motion motor and the nip and idler roller assembly are pivoted about a pivot axis proximate to the lateral motion motor to de-skew the sheet.

In a further embodiment, a sheet registration system includes a nip and idler assembly used to move a sheet along a transport path. A lateral motion motor is coupled to an end portion of the nip and idler roller assembly to move the nip and idler roller assembly along an axis substantially crosswise to the sheet transport path to provide lateral alignment of the sheet. A de-skew assembly coupled to the nip and idler roller assembly pivots the lateral motion motor and the nip and idler roller assembly about a pivot axis proximate to the lateral motion motor to de-skew the sheet.

The above-described features and advantages, as well as others, will become more readily apparent to those of ordinary skill in the art by reference to the following detailed description and accompanying drawings.

DETAILED DESCRIPTION

Figure 1:
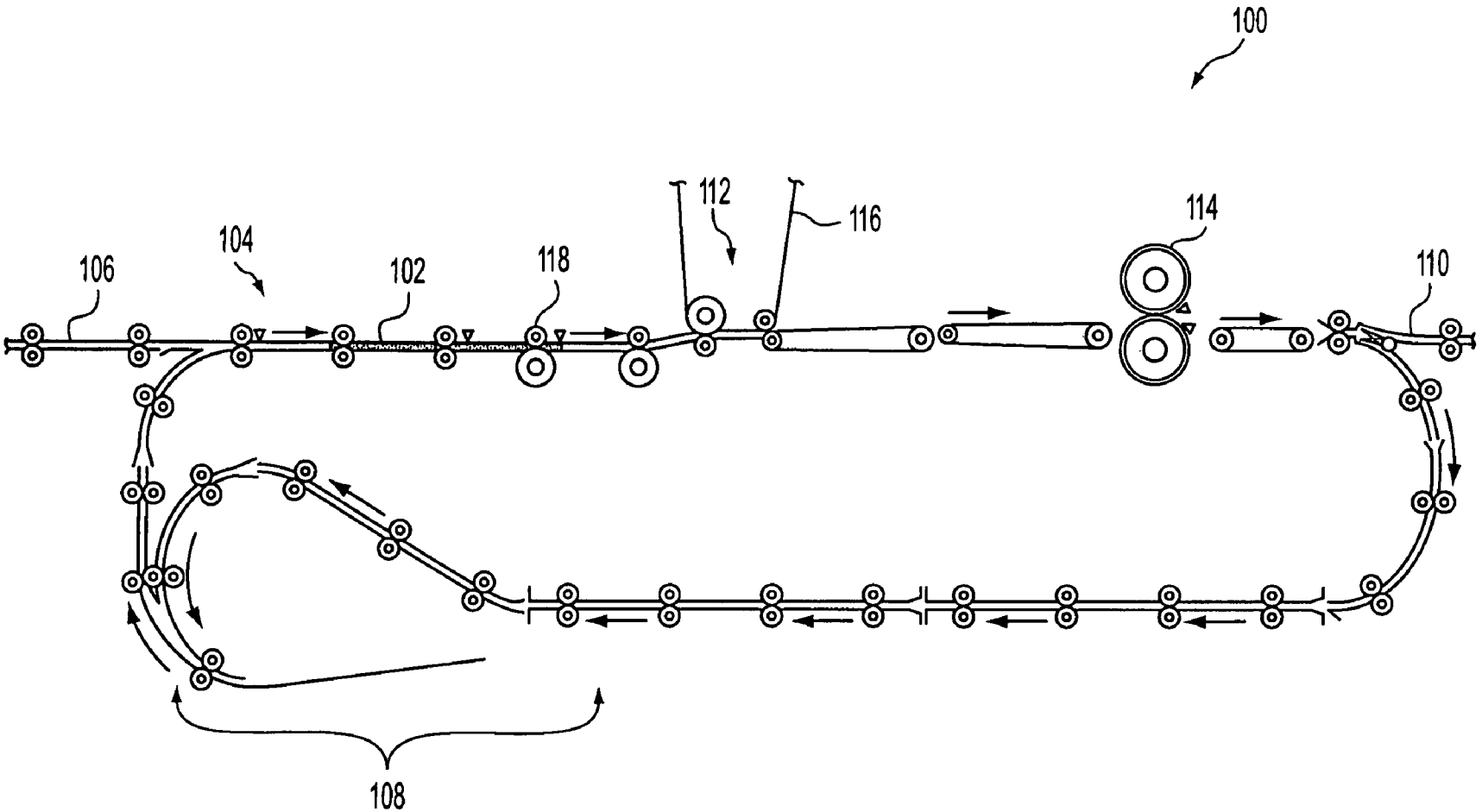
FIG. 1 shows a schematic front view of an exemplary sheet transport system in an electro-photographic machine incorporating an automatic registration system.

Referring to FIG. 1 a schematic front view showing an exemplary electro-photographic printing machine 100 incorporating a registration system wherein sheets such as sheet 102 (image substrates) to be printed are fed along a sheet transfer path 104. The transfer path 104 includes an input 106, a duplexing return path 108, and a sheet output path 110. An image transfer station 112 and an image fuser 114 are also located along the transfer path 104. The image transfer station 112 which transfers developed toner images from a photoreceptor 116 to the sheet 102 is immediately downstream from a sheet registration system 118. The image fuser 114 fuses the transferred image on the sheet 102.

Figure 2:
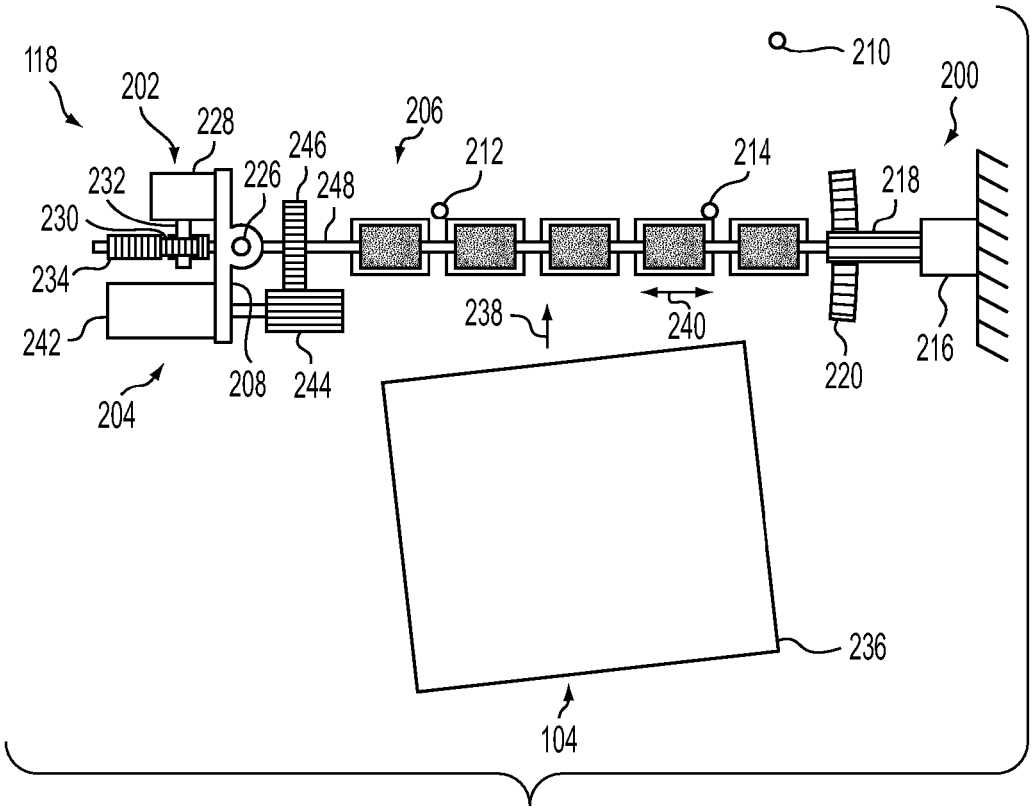
FIG. 2 shows a top view of the automatic registration system of FIG. 1 wherein the process motor and the lateral motor are mounted to a pivot mount.

As shown in FIG. 2, the registration system 118 includes a de-skew assembly 200, a lateral motion assembly 202, a process assembly 204 and a nip and idler roller assembly 206. Also shown in FIG. 2 is a pivot mount 208, a lateral position sensor 210 and two skew sensors 212 and 214.

The de-skew assembly 200 includes a de-skew motor 216 that drives a pinion 218. The pinion 218 is engaged with a rack 220 that is attached to the nip and idler roller assembly 206. The de-skew assembly 200 is used to pivot the nip and idler roller assembly 206 to de-skew a sheet as discussed more fully below. The rack 220 in this embodiment is made of plastic and is slightly curved about an arc centered on the axis of rotation defined by the pivot pin 226.

The lateral motion assembly 202 includes a lateral motion motor 228 that drives a pinion 230 located on the shaft 232 of the lateral motion motor 228. The pinion 230 is engaged with a rack 234 that is attached to the nip and idler roller assembly 206. The lateral motion assembly 204 is used to move the nip and idler roller assembly 206 along an axis that is substantially crosswise to the transfer path 104. In this embodiment, the rack 234 is hollow and rotatably attached to the nip and idler roller assembly 206 such that the nip and idler roller assembly 206 is allowed to rotate within the rack 234.

The transfer path 104 is the path taken by a sheet as it moves through the nip and idler roller assembly 206. The sheet 236 moves through the nip and idler roller assembly 206 generally in the direction of the arrow 238. Accordingly, the lateral motion assembly 202 is used to move the nip and idler roller assembly 206 back and forth cross-wise to the direction of the sheet transfer path 104 substantially in the directions indicated by the double arrow 240. In one embodiment, the lateral motion assembly 202 may be used at the same time as a sheet is being de-skewed as discussed below. Accordingly, the actual movement of the nip and idler roller assembly 206 may not be exactly parallel to the double arrow 240 depending on the orientation of the nip and idler roller assembly 206 as controlled by the de-skew assembly 200.

Figure 3:
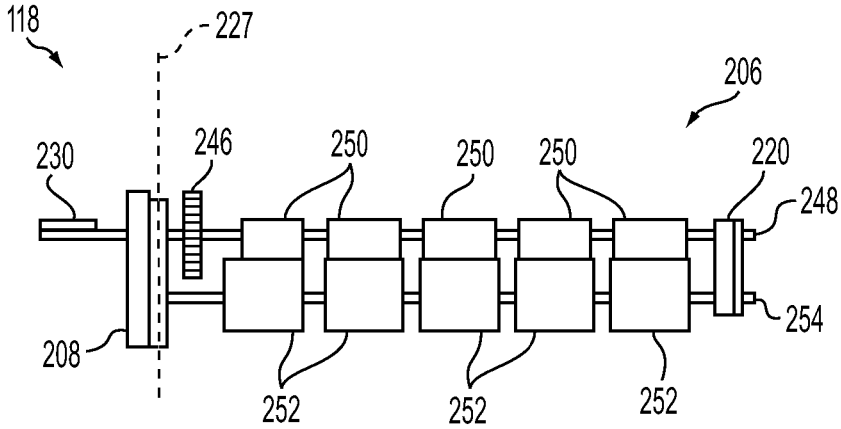
FIG. 3 shows a side view of the automatic registration system of FIG. 1.

The process assembly 204 includes a process motor 242 which drives a gear 244. The gear 244 is engaged with a gear 246 on the nip and idler roller assembly 206. The nip and idler roller assembly 206 includes a drive axle 248 to which the gear 246 is fixedly attached. A plurality of nip rollers 250 are mounted on the drive axle 248 as shown in FIG. 3. The nip and idler roller assembly further includes a plurality of idler rollers 252 mounted on an idler shaft 254 which is located beneath the drive shaft 248. Alternatively, a single, wide roll and idler could be used.

Figure 4:
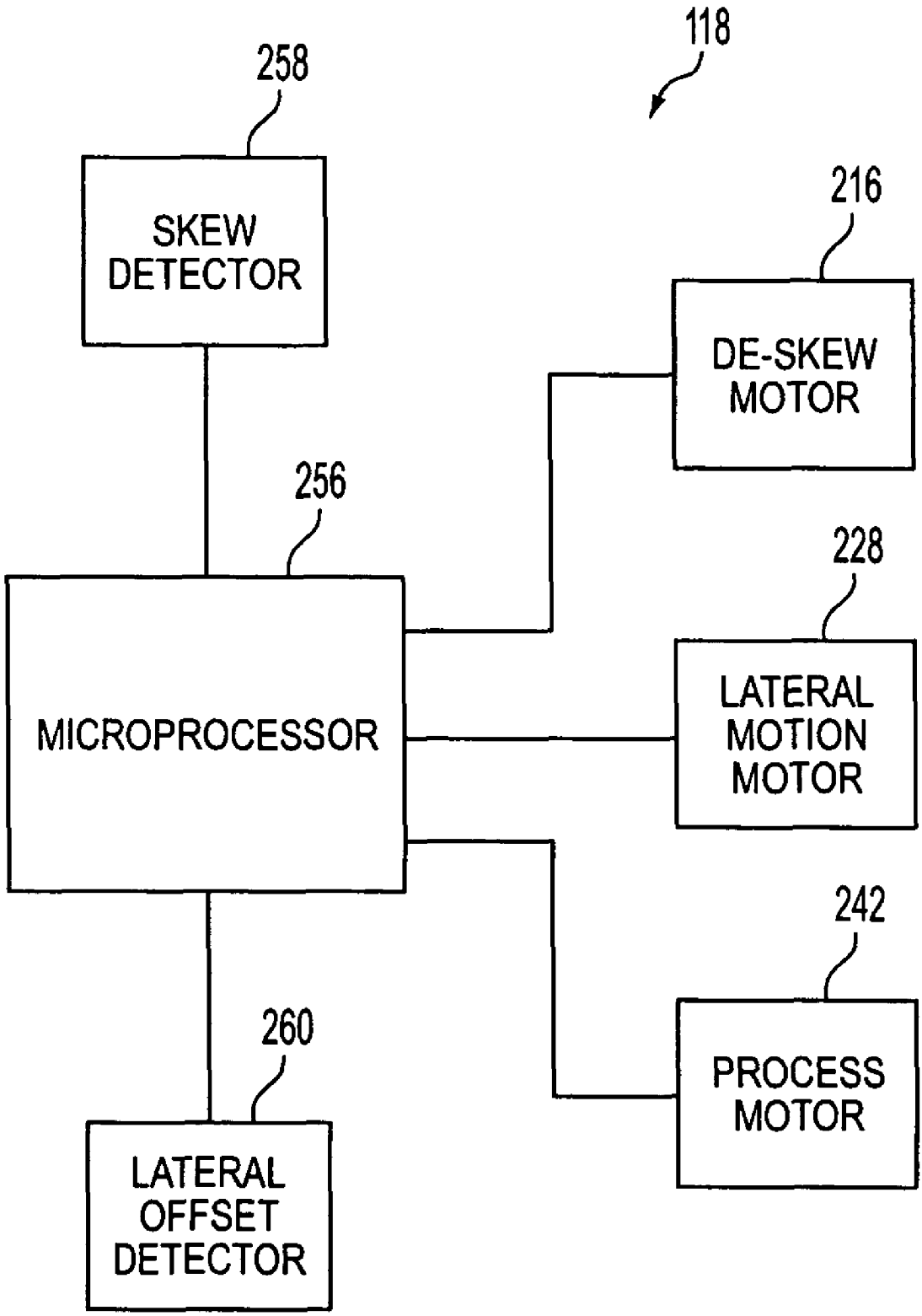
FIG. 4 shows a schematic diagram of the automatic registration system of FIG. 1.

The operation of the registration system 118 is controlled by a microprocessor 256 shown in FIG. 4. The microprocessor 256 receives input from a skew detector 258 and a lateral offset detector 260. Based upon these inputs, the microprocessor 256 controls the de-skew motor 216 and the lateral motion motor 228 to correct the skew and lateral offset of a sheet within the nip and idler roller assembly 206. The microprocessor further controls the process motor 242 so as to deliver the sheet in a coordinated manner to the image transfer station 112.

Figure 5A:
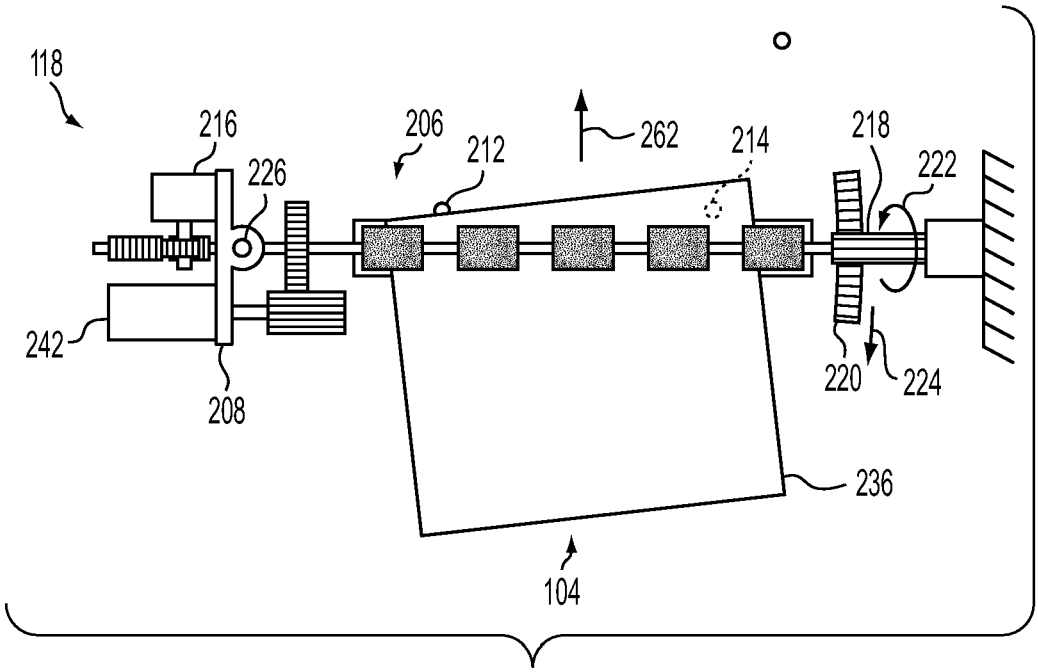
FIGS. 5A-5D show schematic top views of the automatic registration system of FIG. 1 correcting skew and lateral offset of a sheet.

In operation, the sheet 236 of FIG. 2 is advanced along the sheet transfer path 104 toward the registration system 118. The microprocessor 256 activates the process motor 242 thereby rotating the gear 244. The gear 244 in turn causes the gear 246, and thus the drive shaft 248, to rotate. Accordingly, when the sheet 236 contacts the nip and idler roller assembly 206, the leading edge of the sheet 236 is grasped by the opposing nip rollers 250 and idler rollers 252 and advanced along the transfer path 104 by the registration system 118 as shown in FIG. 5A.

In this example, the sheet 236 is skewed and laterally offset. Therefore, as the registration system 118 advances the sheet 236 along the transfer path 104 in the direction of the arrow 262, the leading edge of the sheet 236 is sensed by the skew sensors 212 and 214. The skew detector 258 receives a signal from each of the skew sensors 212 and 214 indicating the detection of the sheet 236 and transmits a signal indicative of the skew of the sheet 236 to the microprocessor 256.

The microprocessor 256 controls rotation of the de-skew motor 216 based upon the amount of skew in the sheet and the speed of the process motor 242. In this example, the right side of the sheet 236 as shown in FIG. 5A is ahead of the left side of the sheet 236 along the transfer path 104. Accordingly, the effective transfer path of the right side of the sheet 236 must be increased, or the relative speed of the left side of the sheet 236 increased, so that the left side of the sheet 236 "catches up" to the right side. Therefore, the microprocessor 256 determines the amount of pivoting of the nip and idler roller assembly 206 that is needed to de-skew the sheet 236 and activates the de-skew motor 216 so as to achieve de-skewing of the sheet 236.

As the de-skew motor 216 rotates in the direction of the arrow 222, the pinion 218 rotates in the same direction, causing the rack 220 to be forced in the direction of the arrow 224. The nip and idler roller assembly 206, however, is attached to the pivot mount 208 which is pivotably mounted on the pivot pin 226. Accordingly, the nip and idler roller assembly 206 is pivoted about the pivot axis 227 (see FIG. 3).

The pivot axis 227 extends perpendicular to and outside of the sheet transport path 104 which passes generally underneath the nip rollers 250. Thus, the nip and idler roller assembly 206 is pivoted in the direction of the arrow 264 to the position shown in FIG. 5B. As can be seen by reference to the location of the skew sensors 212 and 214 with respect to the leading edge of the sheet 236, the rotation of the nip and idler roller assembly 206 has eliminated the skew of the sheet 236 as the sheet 236 continues to be advanced along the sheet transfer path 104 by the nip and idler roller assembly 206.

In this embodiment, the lateral motion assembly 202 and the process assembly 204 are attached to the pivot mount 208. Accordingly, they are also rotated when the nip and idler roller assembly 206 is rotated. The inertia that must be overcome both to begin rotation of the nip and idler roller assembly 206 and to stop the rotation is minimized, however, because the lateral motion assembly 202 and the process assembly 204 are located proximate to the pivot axis 227. Moreover, the de-skew motor 216 is located alongside of the transfer path 104 at the side opposite to the location of the pivot pin 226. Accordingly, a significant mechanical advantage is realized by the de-skew motor 216.

Figure 5B:
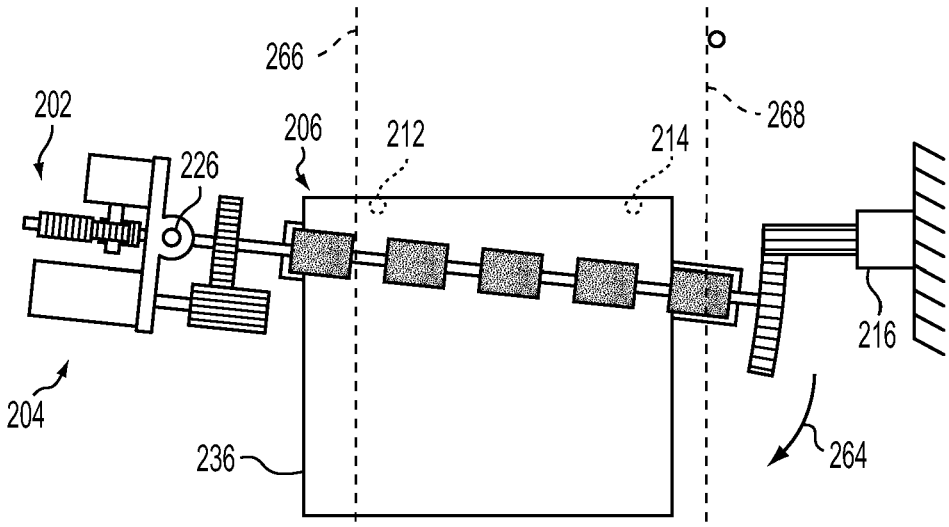

Continuing with the operation of the registration system 118, the microprocessor determines when the sheet 236 should be sensed by the lateral position sensor 210 based upon the speed at which the sheet 236 is being advanced along the sheet transfer path 104 if the sheet 236 is translationally positioned so as to be sensed by the lateral position sensor 210. In the present example, however, while the sheet 236 is no longer skewed, the sheet is laterally offset from the desired final registration position for the sheet 236, the nominal boundaries of which are indicated in FIG. 5B by the dashed lines 266 and 268. Thus, as the sheet 236 continues to be advanced along the sheet transfer path 104 by the nip and idler roller assembly 206 to the position shown in FIG. 5C, the sheet 236 is not sensed by the lateral position sensor 210 at the time expected by the microprocessor 256.

Figure 5C:
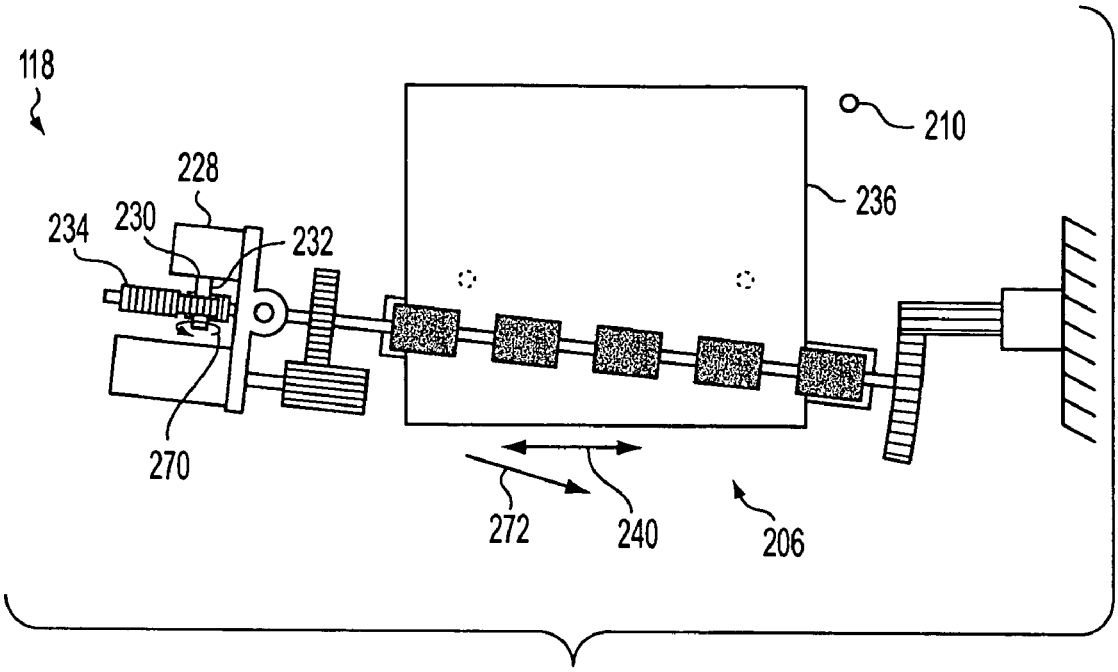

Because the sheet 236 was not detected, the microprocessor 256 causes the lateral motion motor 228 to rotate in the direction of the arrow 270 which causes the pinion 230 to rotate in the same direction. As the pinion 230 rotates, the rack 234 is forced in the direction of the arrow 272. Because the rack is attached to the nip and idler roller assembly 206, the nip and idler roller assembly 206 and the sheet 236 which is grasped by the nip and idler roller assembly 206 also move in the direction of the arrow 272. As shown in FIG. 5C, the cross-wise movement of the nip and idler roller assembly 206 is not parallel to the double arrow 240 because a skew adjustment has been made.

Figure 5D:
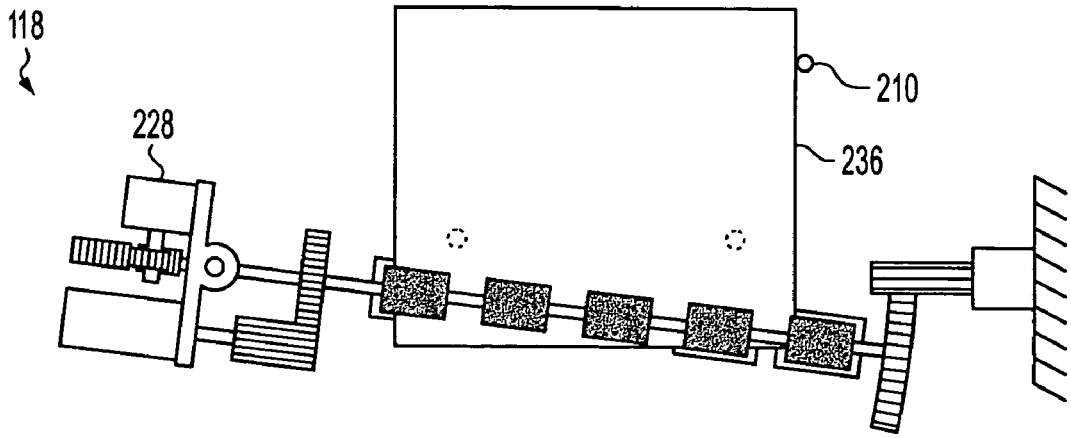

The microprocessor 256 causes continued rotation of the lateral motion motor 228, and thus translation of the sheet 236, as the sheet 236 is advanced along the sheet transfer path 104 by the nip and idler roller assembly 206 until the sheet 236 is in the location shown in FIG. 5D. As shown in FIG. 5D, the sheet 236 has been translated until the outer edge of the sheet 236 is sensed by the lateral position sensor 210 which causes the lateral offset detector 260 to signal the microprocessor 256 that the sheet 236 has been sensed. Once the sheet 236 is sensed by the lateral position sensor 210, the microprocessor 256 reverses the rotation of the lateral motion motor 228 thereby reversing the translation of the sheet 236 as described above until the edge of the sheet 236 is no longer sensed which correlates with the desired final registration location. Of course, in the event that the sheet 236 is initially sensed by the sensor 210, the microprocessor simply translates the sheet 236 in a manner similar to that set forth above until the sheet 236 is no longer sensed.

In either event, the sheet 236 is properly aligned for the transfer of an image at the image transfer station 112. The sheet 236 is still grasped, however, by the nip and idler roller assembly 206 which is not perpendicular to the sheet transfer path 104. Thus, merely continuing to advance the sheet 236 with the nip and idler roller assembly 206 will result in lateral misalignment of the sheet 236. Accordingly, the microprocessor 256 determines the necessary lateral adjustment and causes the lateral motion motor 228 to translate the nip and idler roller assembly 206 so as to maintain the sheet 236 in the desired registration position. The correction may be completed before the sheet 236 is released by the nip and idler roller assembly 206 or simultaneously with the release of the sheet 236.

While the present invention has been described with reference to an embodiment wherein the registration system is integrated into a printing device, those of ordinary skill in the art will appreciate that the present invention may be incorporated into a variety of different devices wherein registration of a sheet is desired. Such devices include printers that utilize many different image marking processes including xerography, solid ink, thermal ink jet and others.

Moreover, the present invention may be used with a number of alternative detection or control schemes. By way of example, the skew of the sheet may be determined upstream of the nip and idler roller assembly. In such an embodiment, once the skew is determined and prior to grasping the sheet with the nip and idler roller assembly, the nip and idler roller assembly is pivoted to the same skew angle as the sheet. It may be further desired to translate the nip and idler roller assembly as the nip and idler roller assembly is being pivoted. This allows the nip and idler roller assembly to be optimally positioned with respect to the sheet transfer path even when the nip and idler roller assembly is at an angle to the sheet transport path. Once the sheet is grasped, the nip and idler roller assembly is pivoted to de-skew both the sheet and nip and idler roller assembly. Lateral correction can then be done and the sheet transported to the next nip or an image transfer station.

In yet a further embodiment, nip releases are used on the paper path drive nips located upstream of the registration system so that sheets would be free to rotate or move in a lateral direction. Such nip releases are commonly used with known paper registration devices. Additionally, lateral position sensors may be located prior to the nip and idler roller assembly. This allows the precise orientation of the sheet to be determined so that skew and lateral translation may be corrected at the same time.

Figure 6:
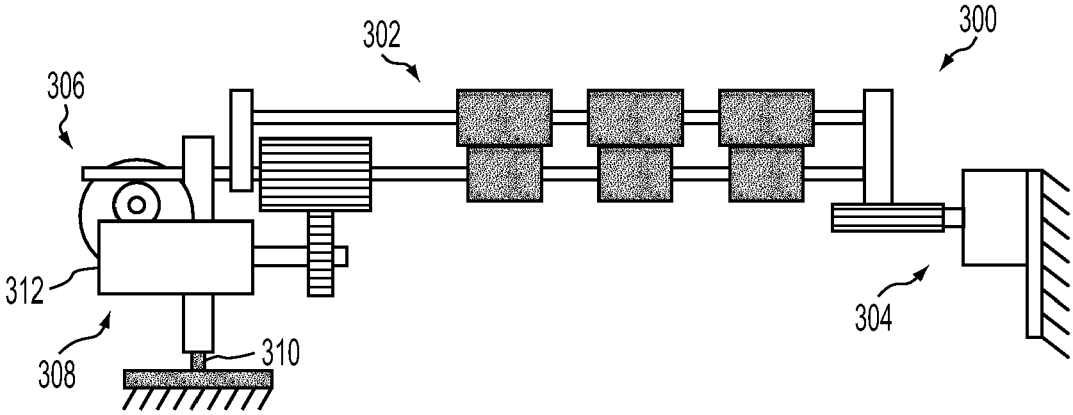
FIG. 6 shows a side view of an automatic registration system wherein the pivot axis is located substantially coaxially with the process motor to minimize the inertia of the process motor and the lateral motor.

Moreover, the weight of the lateral transfer motor and the process motor may vary from one device to another device. Accordingly, the location of the pivot may be varied so as to provide the desired weight distribution. By way of example, FIG. 6 shows a registration device 300 that includes a nip and idler roller assembly 302, a de-skew assembly 304, a lateral motion assembly 306, a process assembly 308 and a pivot pin 310. The crosswise location of the pivot pin 310 is at the middle portion of the housing 312 of the process motor 308. This is in contrast to the crosswise location of the pivot pin 226 shown in FIG. 1 is inboard of the process motor 242.

Figure 7:
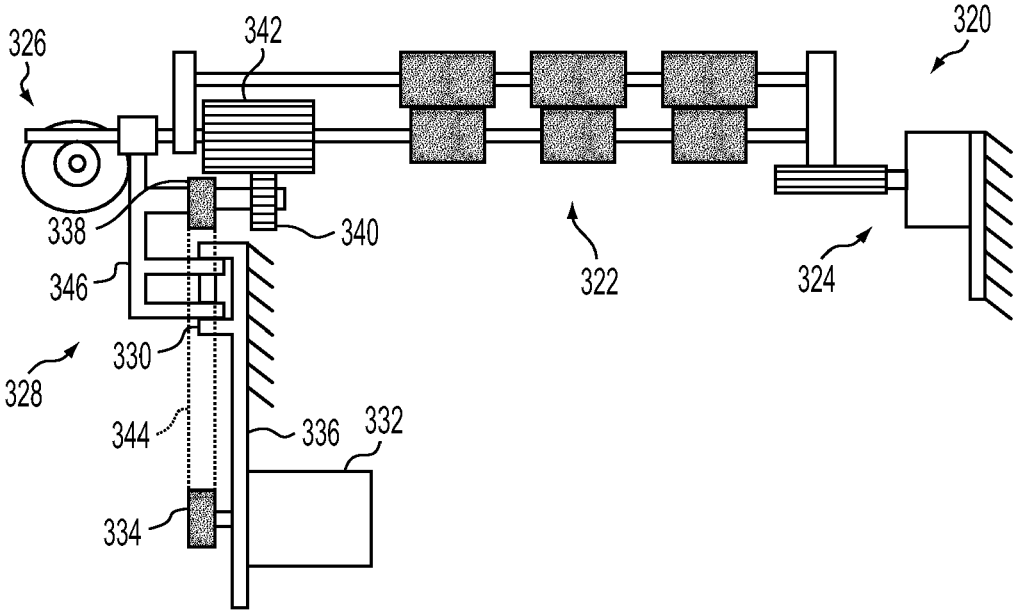
FIG. 7 shows an alternative automatic registration system wherein the process motor is fixedly mounted.

The power required to pivot a nip and idler roller assembly may be further reduced by allowing relative motion between the nip and idler roller assembly and the process motor. By way of example, FIG. 7 shows a registration device 320 that includes a nip and idler roller assembly 322, a de-skew assembly 324, a lateral motion assembly 326 a process assembly 328 and a pivot 330.

The process assembly 328 includes a process motor 332 that is used to a rotate a pulley 334. The process motor 332 is fixedly mounted to the frame 336 of the registration device 320. The process assembly further includes a pulley 338 that is in a fixed relationship with a gear 340. The pulley 334 is connected to the pulley 338 by a belt 344. Thus, when the pulley 334 rotates, the pulley 338 and the gear 340 will also rotate. The gear 340 is engaged with the gear 342 of the nip and idler roller assembly 322. Thus, when the gear 340 rotates the nip and idler roller assembly 322 rotates.

The pulley 338 is mounted to the pivot mount 346. Accordingly, when the de-skew assembly 324 causes the nip and idler roller assembly 322 to pivot, the pulley 338 will pivot. The process motor 332 remains stationary, however, because it is mounted to the frame 336. Rather, the belt 344 twists, allowing for relative motion between the nip and idler roller assembly 322 and the process motor 332, while allowing the process motor to continue to rotate the nip and idler roller assembly 322. Accordingly, in the embodiment of FIG. 7, it is not necessary to pivot the process motor 332.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

We claim:

1. A sheet transport system comprising:

a nip and idler roller assembly for moving a sheet along a sheet transport path, the nip and idler roller assembly having a length that substantially spans the sheet transport path;

a lateral motion motor coupled to the nip and idler roller assembly for moving the nip and idler roller assembly along an axis substantially crosswise to the sheet transport path to provide lateral alignment of the sheet; and a de-skew assembly coupled to the nip and idler roller assembly for pivoting the lateral motion motor and the nip and idler roller assembly about a pivot axis that extends perpendicular to the sheet transport path and proximate to the lateral motion motor, to de-skew the sheet.

2. The system of claim 1, further comprising:

a process motor coupled to the nip and idler roller assembly for driving the nip and idler roller assembly for moving the sheet along the sheet transport path, wherein the de-skew assembly pivots the lateral motion motor, the process motor and the nip and idler roller assembly about the pivot axis.

3. The system of claim 1, wherein the de-skew assembly comprises:

a rack mounted to the nip and idler roller assembly;

a pinion engaged with the rack; and a motor for rotating the pinion to move the rack to cause the lateral motion motor and the nip and idler roller assembly to pivot about the pivot axis, to de-skew the sheet.

4. The system of claim 1, wherein:

the lateral motion motor is located alongside the sheet transport path; and the pivot axis extends alongside the sheet transport path.

5. The system of claim 1, further comprising:

a process motor coupled to the nip and idler roller assembly for driving the nip and idler roller assembly for moving the sheet along the sheet transport path; and a belt coupling the process motor and the nip and idler roller assembly.

6. The system of claim 5, wherein the process motor is located proximate to the pivot axis.

7. A method of registering a sheet in a device comprising:

moving a nip and idler roller assembly along an axis substantially crosswise to a sheet transport path with a lateral motion motor to provide lateral alignment of the sheet; and pivoting the lateral motion motor and the nip and idler roller assembly about a pivot axis that extends proximate to the lateral motion motor to de-skew the sheet.

8. The method of claim 7, wherein pivoting the lateral motion motor and the nip and idler roller assembly comprises pivoting the lateral motion motor and the nip and idler roller assembly about a pivot axis that extends proximate to an end portion of the nip and idler roller assembly.

9. The method of claim 7, further comprising:

driving the nip and idler roller assembly with a process motor to provide movement of the sheet along the sheet transport path, and wherein pivoting the lateral motion motor and the nip and idler roller assembly further comprises pivoting the process motor about the pivot axis.

10. The method of claim 7, wherein pivoting the lateral motion motor and the nip and idler roller assembly further comprises:

rotating a pinion engaged with a rack attached to the nip and idler roller assembly, to de-skew the sheet.

11. The method of claim 7, wherein pivoting the lateral motion motor and the nip and idler roller assembly comprises pivoting the lateral motion motor and the nip and idler roller assembly about a pivot axis located outwardly of the sheet transport path.

12. The method of claim 7, further comprising:

coupling a process motor fixedly attached to the device to the nip and idler roller assembly with a belt; and activating the process motor to provide movement of the sheet along the sheet transport path.

13. The method of claim 7, wherein pivoting the lateral motion motor and the nip and idler roller assembly comprises pivoting a process motor about the pivot axis.

14. The method of claim 7, wherein the moving of the nip and idler roller assembly is performed at the same time as the pivoting of the lateral motion motor and the nip and idler roller assembly.

15. The method of claim 7, further comprising, before moving of the nip and idler roller assembly:

gripping the sheet with the nip and idler roller assembly.

16. The method of claim 7, further comprising:

driving the nip and idler roller assembly with a process motor at the same time as the moving of the nip and idler roller assembly so as to provide movement of the sheet solely in the direction of the sheet transport path.

17. A sheet registration system comprising:

a nip and idler roller assembly for moving a sheet along a sheet transport path, the nip and idler roller assembly having a length that substantially spans the sheet transport path;

a lateral motion assembly coupled to a first end portion of the nip and idler roller assembly for moving the nip and idler roller assembly along an axis substantially crosswise to the sheet transport path to provide lateral alignment of the sheet; and a de-skew assembly coupled to the nip and idler roller assembly for pivoting the lateral motion assembly and the nip and idler roller assembly about a pivot axis that extends perpendicular to the sheet transport path and proximate to the lateral motion assembly to de-skew the sheet.

18. The system of claim 17, further comprising:

a process motor coupled to the nip and idler roller assembly for rotating the nip and idler roller assembly to provide movement of the sheet along the sheet transport path, wherein the de-skew assembly pivots the lateral motion assembly, the process motor and the nip and idler roller assembly about the pivot axis.

19. The system of claim 17, further comprising:

a process motor coupled to the nip and idler roller assembly for rotating the nip and idler roller assembly to provide movement of the sheet along the sheet transport path, wherein the process motor is mounted so that as the nip and idler roller assembly is pivoted, the nip and idler roller assembly moves relative to the process motor; and a belt for coupling the process motor to the nip and idler roller assembly.

20. The system of claim 17, wherein the de-skew assembly is coupled to a second end portion of the nip and idler roller assembly.

* * * * *